US007615914B2

(12) United States Patent
Francesconi et al.

(10) Patent No.: US 7,615,914 B2
(45) Date of Patent: Nov. 10, 2009

(54) SPARK PLUG OF AN INTERNAL COMBUSTION ENGINE

(75) Inventors: Christian Francesconi, Bruck a.d.Mur (AT); Christoph Egger, Jenbach (AT); Johann Klausner, St. Jakob im Haus (AT); Friedrich Gruber, Hippach (AT)

(73) Assignee: GE Jenbacher GmbH & Co OHG, Jenbach (AT)

( * ) Notice: Subject to any disclaimer, the term of this patent is extended or adjusted under 35 U.S.C. 154(b) by 1141 days.

(21) Appl. No.: 10/164,031

(22) Filed: Jun. 5, 2002

(65) Prior Publication Data

US 2002/0180326 A1 Dec. 5, 2002

(30) Foreign Application Priority Data

Jun. 5, 2001 (AT) ..... A 866/2001

(51) Int. Cl.
*H01T 13/20* (2006.01)

(52) U.S. Cl. ..... 313/140; 313/118; 313/141

(58) Field of Classification Search ..... 313/118–145; 123/169 R, 169 EL, 32, 41, 310
See application file for complete search history.

(56) References Cited

U.S. PATENT DOCUMENTS

| | | | | |
|---|---|---|---|---|
| 1,068,462 | A * | 7/1913 | H. M. Spencer | 313/125 |
| 1,538,750 | A * | 5/1925 | Scognamillo | 313/122 |
| 2,776,394 | A | 1/1957 | Cuny et al. | |
| 2,941,363 | A | 6/1960 | Cuny et al. | |
| 3,868,530 | A * | 2/1975 | Eaton et al. | 313/141 |
| 3,958,144 | A | 5/1976 | Franks | |
| 4,490,122 | A * | 12/1984 | Tromeur | 445/7 |
| 4,795,937 | A * | 1/1989 | Wagner et al. | 313/130 |
| 4,987,868 | A | 1/1991 | Richardson | |
| 5,347,855 | A * | 9/1994 | Miyata et al. | 73/114.08 |
| 5,554,908 | A * | 9/1996 | Kuhnert et al. | 313/140 |
| 5,799,637 | A * | 9/1998 | Cifuni | 123/266 |
| 6,121,720 | A | 9/2000 | Rossi | |

(Continued)

FOREIGN PATENT DOCUMENTS

CA 2320415 * 9/2000

(Continued)

OTHER PUBLICATIONS

Search Report from the European Patent Office dated Aug. 19, 2002 for European Application No. EP 02 01 0193, Bijn, E. Examiner.

*Primary Examiner*—Peter J Macchiarolo
*Assistant Examiner*—Donald L Raleigh
(74) *Attorney, Agent, or Firm*—Wenderoth, Lind & Ponack, L.L.P.

(57) ABSTRACT

A spark plug of an internal combustion engine, in particular for use in Otto-cycle gas engines, comprising an insulator body, a base central electrode, at least one ground electrode and at least one swirl chamber, wherein the electrodes of the spark plug are surrounded by a wall, which in particular is in the form of a surface of a cylinder, of the swirl chamber, wherein at least one ground electrode carrier arrangement (8) with a plurality of inwardly facing, preferably flat ground electrodes (9) or a plurality of ground electrode carriers (6) each with inwardly facing, preferably flat ground electrodes (9) is or are arranged at the wall (13) of the swirl chamber (3).

26 Claims, 2 Drawing Sheets

U.S. PATENT DOCUMENTS

| | | | | |
|---|---|---|---|---|
| 6,188,166 | B1 * | 2/2001 | Nishikawa et al. | 313/141 |
| 6,362,562 | B1 * | 3/2002 | Rossi | 313/141 |
| 6,583,539 | B1 * | 6/2003 | Zamora | 313/143 |

FOREIGN PATENT DOCUMENTS

| | | |
|---|---|---|
| FR | 764079 | 5/1934 |
| FR | 985788 | 7/1951 |
| FR | 2071129 | 9/1971 |
| FR | 2131938 | 11/1972 |
| JP | 50-77738 | 9/1974 |
| JP | 57-018283 | 1/1982 |
| JP | 58-162719 | 9/1983 |
| JP | 2-148588 | 12/1990 |
| JP | 4-133281 | 5/1992 |

* cited by examiner

SPARK PLUG OF AN INTERNAL COMBUSTION ENGINE

BACKGROUND OF THE INVENTION

The present invention concerns a spark plug of an internal combustion engine, in particular for use in Otto-cycle gas engines, comprising an insulator body, a base central electrode, at least one ground electrode and at least one swirl chamber, wherein the electrodes of the spark plug are surrounded by a wall, which in particular is in the form of a surface of a cylinder, of the swirl chamber. The invention further concerns a process for producing a spark plug.

The spark plugs which are available at the present time for industrial gas engines are in many cases products which were derived from the automobile industry and adapted by suitable improvements for the preferential use in industrial gas engines. Those spark plugs generally have a cylindrical central electrode which is provided with a precious metal pin. In regard to the ground electrodes, both configurations with a hook electrode and also configurations with between two and four laterally disposed electrode fingers are in use. The hook electrodes can also be provided with a precious metal plate portion. Such spark plugs are known for example from EP 0 834 973 A2, EP 0 859 436 A1, EP 1 049 222 A1, DE 196 41 856 A1 and WO 95/25372. The disadvantage of those spark plugs is essentially inter alia that the flow conditions in the region of the ignition location depend entirely on the flow conditions in the combustion chamber of the respective cylinder. Thus for example the ignition spark can be blown out if the flow speeds of the gas-air mixture are excessively great.

In order to eliminate that disadvantage, it is already known from U.S. Pat. Nos. 5,554,908 A, 2,776,394 A and FR 2 131 938 A for the electrodes of the spark plug to be surrounded by a cylindrical swirl or turbulence chamber. The arrangement illustrated in U.S. Pat. No. 5,554,908 A however suffers inter alia from the disadvantage that it does not have any defined ground electrodes and the ignition sparks are propagated between the central electrodes and any point on the swirl chamber which functions as a ground electrode. In the case of the spark plugs shown in U.S. Pat. No. 2,776,394 A and FR 2 131 938 A there is the disadvantage that there are in each case only one or two ground electrodes of small area, which have comparatively short service lives and which rapidly become useless due to wear or fouling.

SUMMARY OF THE INVENTION

Therefore the object of the present invention is to provide a spark plug having a swirl chamber and a process for the production thereof, in which the above-discussed disadvantages of the state of the art are eliminated.

In accordance with the invention that is achieved in that at least one ground electrode carrier arrangement with a plurality of inwardly facing, preferably flat ground electrodes or a plurality of ground electrode carriers each with inwardly facing, preferably flat ground electrodes is (are) arranged at the wall of the swirl chamber.

Enclosing the electrode region by means of the swirl chamber means that controlled flow and turbulence conditions in respect of the fuel-air mixture can be implemented at the ignition location. That ensures that, at the ignition location, the arrangement involves a flow speed and fuel-air mixture turbulence, which are optimum for ignition and the progress of the ignition process. That results in optimised and rapid combustion of the fuel-air mixture in the combustion chamber of the cylinder and thus affords optimum and environmentally friendly energy yield from the internal combustion engine. In accordance with the invention arranging a ground electrode carrier arrangement or a plurality of ground electrode carriers at the swirl chamber ensures that on the one hand a plurality of ignition sparks are produced at the same time and on the other hand they go along defined spark paths. That increases both the service life and also the reliability of the spark plug.

It is particularly desirable in that respect if the wall of the swirl chamber has openings to allow fuel-air mixture to pass therethrough. In that respect those openings are so designed that they permit good access for the mixture.

To provide for optimum ignition of all the fuel-air mixture in the combustion chamber, it is particularly desirable if the end of the wall of the swirl chamber, which is at the combustion chamber side, has an opening, or is completely opened. Advantageous variants of the openings in the wall of the swirl chamber provide that it or they is or are in the form of a bore or bores or a slot or slots and/or a polygon or polygons and/or an ellipse or ellipses.

To provide for optimum influence on the flow speeds of the fuel-air mixture in the region of the ignition location, it is particularly desirable for the end of the wall of the swirl chamber, at the combustion chamber side, to project out beyond the electrodes.

In order to permit a suitable voltage build-up or current flow, the wall of the swirl chamber is electrically conductive and is electrically conductively connected to a lower housing portion which preferably has a screwthread. That ensures that the ground electrodes are grounded by way of the ground electrode carriers or the ground electrode carrier arrangement and by way of the wall of the swirl chamber and the spark plug housing conductively connected thereto.

In that respect advantageous configurations provide that the ground electrode carriers or the ground electrode carrier arrangement is or are welded to the wall of the swirl chamber. As an alternative thereto it can also be provided that the ground electrode carrier arrangement is in the form of an integrated component, preferably integrated ring-like into the wall of the swirl chamber. In this respect the term ground electrode carrier arrangement denotes an arrangement of a plurality of ground electrode carriers, on each of which is in turn arranged at least one ground electrode. Advantageous embodiments of the ground electrode carrier arrangement provide that at least one ground electrode carrier arrangement has preferably four mutually perpendicularly arranged flat ground electrodes. It is particularly desirable in terms of manufacture and durability for the swirl chamber to be formed in one piece together with the ground electrode carriers or the ground electrode carrier arrangement.

As a counterpart to that nature of the ground electrode carrier arrangement or the ground electrode carriers, it is particularly desirable for the spark plug to have at least one central electrode carrier, wherein preferably four mutually perpendicularly arranged, flat, preferably outwardly facing central electrodes are disposed on the central electrode carrier. In this case the central electrode carrier can again have one or more fingers or individual central electrode carriers, wherein again at least one central electrode is respectively arranged on the fingers or individual central electrode carriers. In advantageous developments, this combination provides that the electrodes of the central electrode carrier and the ground electrode carriers or the ground electrode carrier arrangement are respectively arranged in pairs in plane-parallel oppositely disposed relationship, having an insulating air gap between each other. In this case, referring to the overall component size, very long electrode burn-away edges are achieved. This contributes substantially to an improvement in the operating life of the spark plug.

An advantageous variant further provides that the wall of the swirl chamber is in the form of an integrated component part of the lower housing portion. A further preferred embodiment provides that the swirl chamber in the region of at least one ground electrode carrier and/or at least one ground electrode carrier arrangement has at least one opening for adjusting the ground electrode carrier and/or the ground electrode carrier arrangement and/or the ground electrode. The service life of the spark plug is further improved by virtue of that possibility of adjusting the electrodes. In addition adaptation of the electrode gap to varying operating parameters is possible. In addition it can also be provided that the central electrode carrier is adapted to be adjustable.

A particularly advantageous process for the production of a spark plug in accordance with the above-specified features provides that the wall of the swirl chamber with at least one ground electrode and/or at least one ground electrode carrier and/or with at least one ground electrode carrier arrangement and/or the central electrode carrier is produced individually and then fitted to commercial spark plugs. That process according to the invention therefore makes it possible to use inexpensive standard industry spark plugs as are commercially offered by various spark plug manufacturers. That manufacturing process makes it possible to produce a spark plug according to the invention from very many different standard industry spark plug types. In addition inexpensive production of very many different spark plugs is possible.

With this process it is particularly desirable for the wall of the swirl chamber to be welded to at least one ground electrode of a commercial spark plug by means of pulsed and/or continuously operating laser welding processes and/or electrode beam welding processes and/or brazing processes and/or resistance welding processes. In addition it is desirable for the central electrode carrier to be welded to at least one base central electrode of the insulator body of a commercial standard spark plug by means of pulsed and/or continuously operating laser welding processes and/or electrode beam welding processes and/or brazing processes and/or resistance welding processes.

BRIEF DESCRIPTION OF THE DRAWING

Further features and details of the present invention will be apparent from the specific description hereinafter. In the drawing.

DETAILED DESCRIPTION OF THE INVENTION

Figure 1:
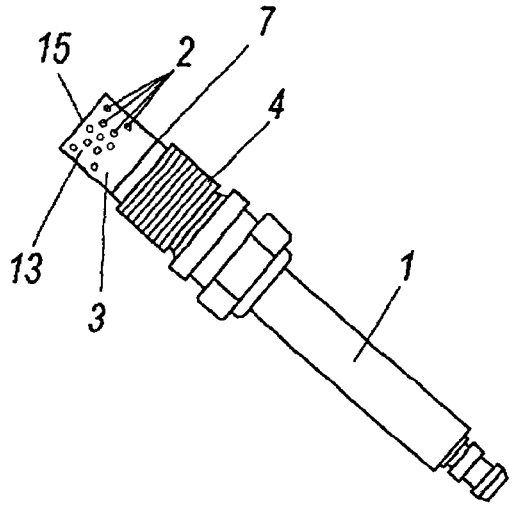
FIG. 1 shows a standard industry spark plug with a swirl chamber according to the invention.
Figure 2:
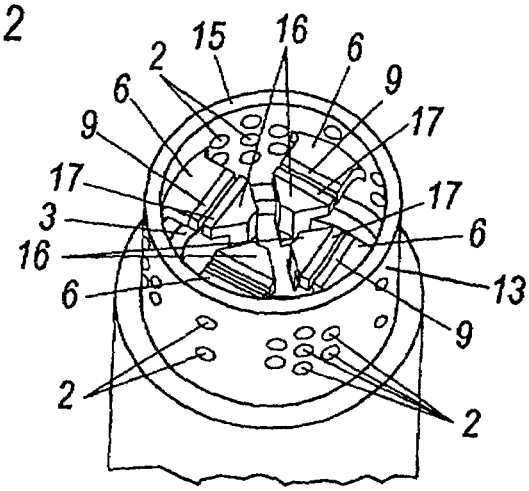
FIGS. 2, 3 and 4 show perspective views of the swirl chamber according to the invention from the direction of the combustion chamber.

In the case of the spark plug with swirl chamber 3, as shown in FIG. 1, recourse is made to a standard industry spark plug as is commercially offered by various spark plug manufacturers.

Mounted to the lower housing portion 1 at the engine side is a swirl chamber 3, with the end 15 thereof that is towards the combustion chamber being open. In the specific case, for reasons of resistance to temperature and hot corrosion, an open swirl chamber 3 with a wall 13 of Inco Alloy 600 (Wno 2.4816) is welded by means of laser at the weld seam 7 to the lower housing portion 4. As alternatives, it is also possible to use other nickel-based alloys or high-temperature high-quality steels for the wall 13. The swirl chamber 3 is alternatively also made in one piece, that is to say as an integral component part of the lower housing portion 4.

The wall 13 of the swirl chamber 3 has openings 2 which permit good access for the mixture. The openings 2 can be in the form of bores, slots, polygons or ellipses or of a similar shape.

Figure 3:
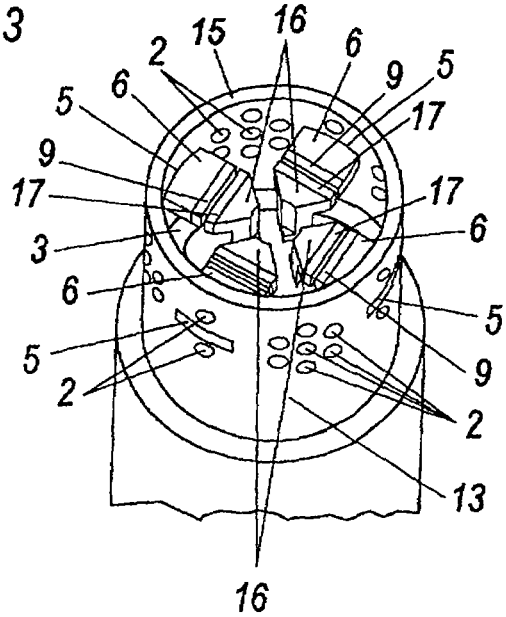
Figure 4:
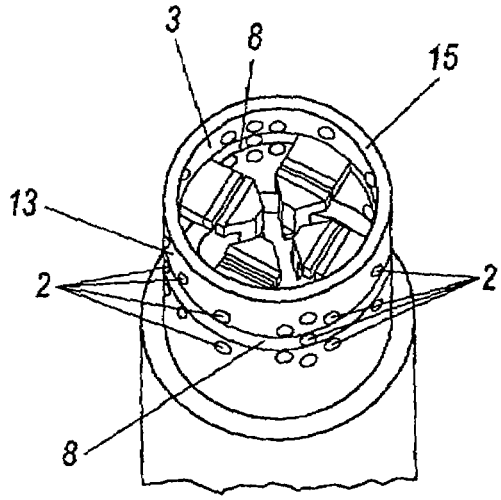

In accordance with the invention, an integral component part of the swirl chamber are the four ground electrode carriers 6. The swirl chamber 3 and the ground electrode carriers 6 can be produced in one piece. It is however also possible for rectangular metal parallelepipeds 5 to be welded as ground electrode carriers 6 into the swirl chamber (FIG. 3). That can also be effected by welding in a ground electrode carrier arrangement 8. This is shown in FIG. 4, in the form of an annular arrangement 8.

Figure 5:
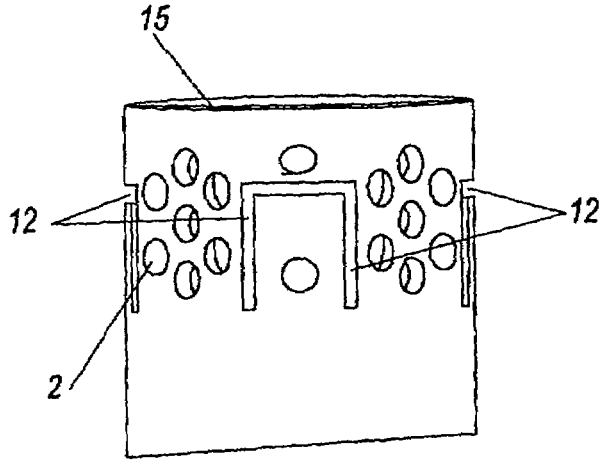
FIG. 5 shows a side view of the swirl chamber according to the invention with openings.

In the region of the ground electrode carrier the wall 13 of the swirl chamber 3 can have one or more openings 12, whereby it is possible to adjust the ground electrode carriers 6 or the ground electrode carrier arrangement 8 (FIG. 5).

The ground electrode carriers 6 are provided with precious metal plate portions as ground electrodes 9, they are welded to the carrier 6 by means of laser at one side or on both sides. The welding is such that the gap is closed at the electrode sides. In other words, between the precious metal plate portions 9 and the ground electrode carrier 6, there is no open gap (or aperture) through which gas can enter.

By virtue of this structure it is possible to produce very long electrode burn-away edges, in relation to the overall component size. The ground electrodes used are precious metal plate portions with an edge length of greater than 4.0 mm. In the illustrated embodiment the edge length is 6.25 mm.

In regard to the ground electrodes 9, the illustrated embodiment uses precious metal plate portions measuring 6.25×1.6×0.5 mm (it is also possible to employ other dimensions). The precious metal used can be for example an alloy of PtRh alloys (90/10, 95/5, 80/20, 75/25).

The welding processes used can be pulsed lasers, continuously operating lasers (CW-lasers), electron beam welding processes or vacuum and high-vacuum brazing processes as well plasma welding or resistance welding.

Figure 6:
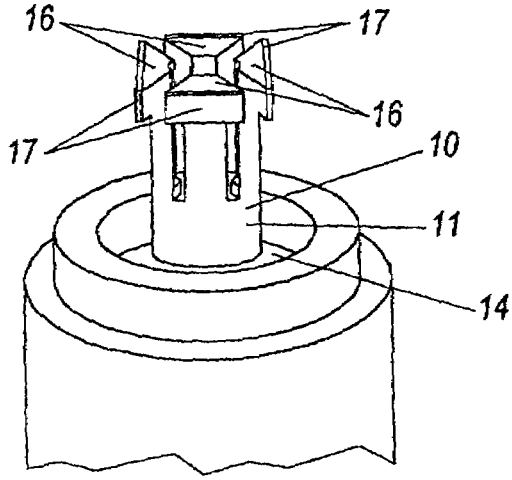
FIG. 6 shows a perspective side view of the central electrode carrier, with the swirl chamber according to the invention removed.

As shown in FIG. 6 the base central electrode (not shown here) of the spark plug insulator 1 is welded to a central electrode carrier 10. The spark position can be established by the central electrode carrier 10, in conformity with the swirl chamber 3 and the ground electrodes 6 or the ground electrode carrier arrangement 8. The central electrode carrier 10 is pushed on to the base central electrode until it bears flush against the ceramic central electrode insulator base 14. In that position it is welded to the base central electrode at the weld 11. This arrangement means that the base central electrode is resistant to high pressure. It is not possible for it to be expelled from the ceramic base, caused by the engine pressure, as the central electrode carrier 10 which is welded to the base central electrode is shouldered against the ceramic base 14. The weld connection 11 between the central electrode carrier 10 and the base central electrode is produced by welding with a pulsed laser. It is however also possible to use a continuously operating laser (CW-laser), the electron beam welding process, a brazing process or resistance welding.

The weld 11 can be made along the entire length of the base central electrode, in which case therefore welding is effected from the outside through the central electrode carrier 10 on to the base central electrode. It is possible to produce one or more spot welds or one or more seam welds which can be arranged on the longitudinal axis if required at a plurality of locations at the periphery or radially if required at a plurality of locations at the periphery.

The central electrode carrier 10 is so designed that it permits good accessibility for the mixture. Easy adjustment is possible by virtue of its design configuration as shown in detail in FIG. 6. The central electrode carrier is so designed that central electrode precious metal plate portions 17 of a length of greater than 4 mm can be welded on. In the case of the specific invention, the edge length of the central electrode carriers 17 is 6.25 mm. The central electrode carrier 10 is designed with four separate individual central electrode carriers 16, on which the precious metal plate portions are welded as central electrodes 17. They are welded to the carrier by means of laser at one side or both sides. The welding is such that the gap is closed at the electrode sides. In other words, between the precious metal plate portions and the electrode carrier fingers there is no open gap (or aperture) through which gas can enter.

The material for the central electrode carrier 10 in the specific case here is Inco Alloy 600 (Wno 24816). As alternatives it is also possible to use other nickel-based alloys or high-temperature high-quality steels.

In the case of the precious metal for the central electrodes 17, plate portions of the dimensions 6.25×2.0×0.5 mm are used (it is also possible to employ other dimensions). The precious metal used can be for example once again PtRh alloys (90/10, 95/5, 80/20, 75/25).

The invention claimed is

1. A spark plug of an internal combustion engine, comprising an insulator body, a base central electrode, at least one ground electrode and at least one swirl chamber, wherein the electrodes of the spark plug are surrounded by a wall of the swirl chamber, and wherein at least one ground electrode carrier arrangement with a plurality of inwardly facing ground electrodes or a plurality of ground electrode carriers each with inwardly facing ground electrodes, the said ground electrodes or ground electrode carriers projecting from the wall of the swirl chamber.

2. A spark plug as set forth in claim 1 wherein the internal combustion engine is an Otto-cycle gas engine.

3. A spark plug as set forth in claim 1 wherein the wall, which surrounds the electrodes of the spark plug, is in the form of a surface of a cylinder.

4. A spark plug as set forth in claim 1 wherein the ground electrodes are flat.

5. A spark plug as set forth in claim 1 wherein the wall of the swirl chamber has openings for fuel-air mixture to pass therethrough.

6. A spark plug as set forth in claim 1 wherein the end of the wall of the swirl chamber, which is at the combustion chamber side, has an opening or is completely opened.

7. A spark plug as set forth in claim 5 wherein the opening or openings is or are in the form of a bore or bores or a slot or slots or a polygon or polygons or an ellipse or ellipses.

8. A spark plug as set forth in claim 1 wherein the end of the wall of the swirl chamber, which is at the combustion chamber side, projects beyond the electrodes.

9. A spark plug as set forth in claim 1 wherein the wall of the swirl chamber is electrically conductive and is electrically conductively connected to a lower housing portion.

10. A spark plug as set forth in claim 1 wherein the ground electrode carrier or the ground electrode carrier arrangement is or are welded to the wall of the swirl chamber.

11. A spark plug as set forth in claim 1 wherein the ground electrode carrier arrangement is integrated as an integrated component into the wall of the swirl chamber.

12. A spark plug as set forth in claim 1 wherein the swirl chamber is formed in one piece together with the ground electrode carriers or the ground electrode carrier arrangement.

13. A spark plug as set forth in claim 1 wherein the ground electrode carrier arrangement comprises four mutually perpendicularly arranged flat ground electrodes.

14. A spark plug as set forth in claim 1 wherein the wall of the swirl chamber has in the region of at least one ground electrode carrier or at least one ground electrode carrier arrangement at least one opening for adjustment of the ground electrode carrier or the ground electrode carrier arrangement or the ground electrode.

15. A spark plug as set forth in claim 1 wherein the spark plug has at least one central electrode carrier, wherein at least one flat outwardly facing central electrode is arranged on the central electrode carrier.

16. A spark plug as set forth in claim 15 wherein the electrodes of the central electrode carrier and the ground electrode carrier arrangement are respectively arranged in pairs in plane-parallel oppositely disposed relationship, having an insulating air gap between each other.

17. A spark plug as set forth in claim 15 wherein the central electrode carrier is adapted to be adjustable.

18. A spark plug as set forth in claim 1 wherein the wall of the swirl chamber is produced as an integrated component part of the lower housing portion.

19. A spark plug as set forth in claim 15 wherein the edge length of at least one electrode of the ground electrode carrier arrangement and the central electrode carrier is greater than 4 mm.

20. A spark plug as set forth in claim 15 wherein the wall of the swirl chamber and the central electrode carrier and the ground electrode carrier arrangement are made from Inco Alloy 600 or nickel-based alloy or high-temperature high-quality steels.

21. A spark plug as set forth in claim 15 wherein the electrodes of the central electrode carrier and the ground electrode carrier arrangement have a coating of precious metal or precious metal plate portions.

22. A process for the production of a spark plug as set forth in claim 1 wherein the wall of the swirl chamber with at least one ground electrode and at least one ground electrode carrier or at least one ground electrode carrier arrangement and the central electrode carrier are produced individually and then fitted to commercial spark plugs.

23. A process as set forth in claim 22 wherein the wall of the swirl chamber is welded to at least one ground electrode of a commercial spark plug by means of pulsed or continuously operating laser welding processes or electrode beam welding processes or brazing processes or resistance welding.

24. A process as set forth in claim 23 wherein the central electrode carrier is welded to at least one base central electrode of the insulator body of a commercial standard spark plug by means of pulsed and continuously operating laser welding processes or electrode beam welding processes or brazing processes and resistance welding.

25. A spark plug as set forth in claim 9 wherein the lower housing portion comprises a screwhead.

26. A spark plug as set forth in claim 19 wherein the edge length of at least one electrode of the ground electrode carrier arrangement and the central electrode carrier is 6 mm.

* * * * *